US005868343A

United States Patent [19]

Granger

[11] Patent Number: 5,868,343

[45] Date of Patent: Feb. 9, 1999

[54] FOLDED/UNFOLDED PAPER TOWEL DISPENSING APPARATUS

[76] Inventor: Maurice Granger, 17 Rue Marcel Pagnol, Saint Preist en Jarez, France

[21] Appl. No.: 875,840

[22] PCT Filed: Feb. 5, 1996

[86] PCT No.: PCT/FR96/00184

§ 371 Date: Aug. 6, 1997

§ 102(e) Date: Aug. 6, 1997

[87] PCT Pub. No.: WO96/24281

PCT Pub. Date: Aug. 15, 1996

[30] Foreign Application Priority Data

Feb. 7, 1995 [FR] France ..... 95 01693
Dec. 26, 1995 [FR] France ..... 95 15847

[51] Int. Cl.[6] ..... B65H 20/02

[52] U.S. Cl. ..... 242/564.4; 242/423; 225/14

[58] Field of Search ..... 242/423, 564.4; 225/14, 15; 83/335, 337, 338

[56] References Cited

U.S. PATENT DOCUMENTS 4,213,363 7/1980 Granger .
4,432,261 2/1984 DeLuca .
5,078,033 1/1992 Forman ..... 83/335
5,146,830 9/1992 Granger ..... 83/337
5,161,723 11/1992 Wirtz-Odenthal .
5,257,711 11/1993 Wirtz-Odenthal ..... 225/14
5,441,189 8/1995 Formon et al. ..... 225/15
5,526,973 6/1996 Boone et al. ..... 242/564.4

FOREIGN PATENT DOCUMENTS 0 522 477 1/1993 European Pat. Off. .
2717789 3/1994 France .
2718937 4/1994 France .

*Primary Examiner*—John P. Darling
*Attorney, Agent, or Firm*—Wall Marjama Bilinski & Burr

[57] ABSTRACT

Paper towel dispensing apparatus comprising at least one device for braking (12) the material take-off reel (B), this device being associated with an operating cycle of the apparatus involving rotation of the drum (4) of one revolution so as to dispense a length of material, said braking device being arranged laterally on one side of the drum and hinged relative to the housing (2), directly linked to rotation or non-rotation of the drum and ensuring, depending whether or not the apparatus is operating, braking-action contact on at least one of the lateral sides (B1) of the reel (B) or release of the latter so that it can rotate one cycle, the operation or release of the braking device being controlled by the action performed by the user on the strip of material emerging from the apparatus.

18 Claims, 9 Drawing Sheets

FOLDED/UNFOLDED PAPER TOWEL DISPENSING APPARATUS

FIELD OF THE INVENTION

The invention relates to the technical sector of apparatus for dispensing cellulose wadding, creped paper towels and towels of similar materials, especially those used for wiping the user's hands, toilet paper and paper napkins.

BACKGROUND OF THE INVENTION

The Applicant has developed several apparatus for dispensing paper towels that are the subject of several patent applications in France and abroad which allow operation and dispensing of paper in folded or unfolded form.

Briefly, such apparatus generally comprises a reel of material, enclosed in a support housing, the reel capable of being unwound and routed towards a drum that includes a cutting device capable of dispensing strips of material cut to predetermined lengths.

In a first embodiment, the strip of paper can be unwound flat over the entire length of the drum or, in the context of an alternative embodiment, by using a special frame support such as that described in French Patent applications 94.04399 and 94.05698, the paper being dispensed in folded form.

Such apparatus are extremely reliable in operation but, in some cases, there may be a problem, caused by a high tensile force, of the strip of paper being unwound from the reel in a manner which creates, between the drum and the reel, a loose strip which eliminates any tension between the reel and the drum. It is then necessary to reduce or eliminate this loose strip by an additional action to dispense a strip of paper. This situation results from the fact that the reel of material placed between the flanges of the housing is rotatably mounted and must allow the unimpeded dispensing of the paper.

SUMMARY OF THE INVENTION

The object sought after by the invention is therefore to overcome the above drawbacks by proposing, in a simple manner, the possibility of controlling unwinding of the reel of material and adjusting the dispensing of a length of strip as a function of one rotation of the drum whilst ensuring control of tensioning of the strip of material.

Another object sought after by the invention is to provide a device that is perfectly suitable for apparatus for dispensing a material that can be dispensed in folded or unfolded form without any excessive increase in cost.

These objects and others will become apparent from the following description.

According to the invention, the dispensing apparatus for paper towels is of the type comprising a housing having lateral flanges capable of accommodating, in its upper part, a reel-holder or end pieces to support and feed a reel of paper towel, toilet paper or paper napkins or similar and, in its lower part, a drum supporting a cutting device and means of pressing against the drum allowing transport of the strip of paper with a view to dispensing and ejecting it, said drum and said means of applying pressure being mounted crosswise by their shafts between said flanges, at least one of the ends of the shaft of the drum extending as a control knob making it possible to load the apparatus and eject the paper intended to be held in the hand.

According to a first aspect, the apparatus comprises at least one device for braking the material take-off reel, this device being associated with an operating cycle of the apparatus involving rotation of the drum of one revolution so as to dispense a length of material, said braking device being arranged laterally on one side of the drum and hinged relative to the housing, directly linked to rotation or non-rotation of the drum and ensuring, depending whether or not the apparatus is operating, braking-action contact on at least one of the lateral sides of the reel or release of the latter so that it can rotate one cycle, the operation or release of the braking device being controlled by the action performed by the user on the strip of material emerging from the apparatus.

According to another aspect of the invention, the braking device comprises a long lever of which the middle part is hinged relative to the flange and having, in its upper part, an arm that cooperates with a shape forming a ramp on a support plate, said arm accommodating means forming a pad that protrudes against the flank of the reel and in that the lower part of the lever has a hook shape that cooperates with a fixed limit stop placed in the lower part of the housing, said lever also having a curved profile that cooperates with a cam placed on the flange of the drum, said cam being shaped to allow a trajectory of the lever during rotation of the drum or its stopping in order to define the braking and non-braking phases of the reel of material.

These aspects and others will become apparent from the following description.

BRIEF DESCRIPTION OF THE DRAWINGS

The object of the invention is described, merely by way of example, in the accompanying drawings in which.

Figure 1:
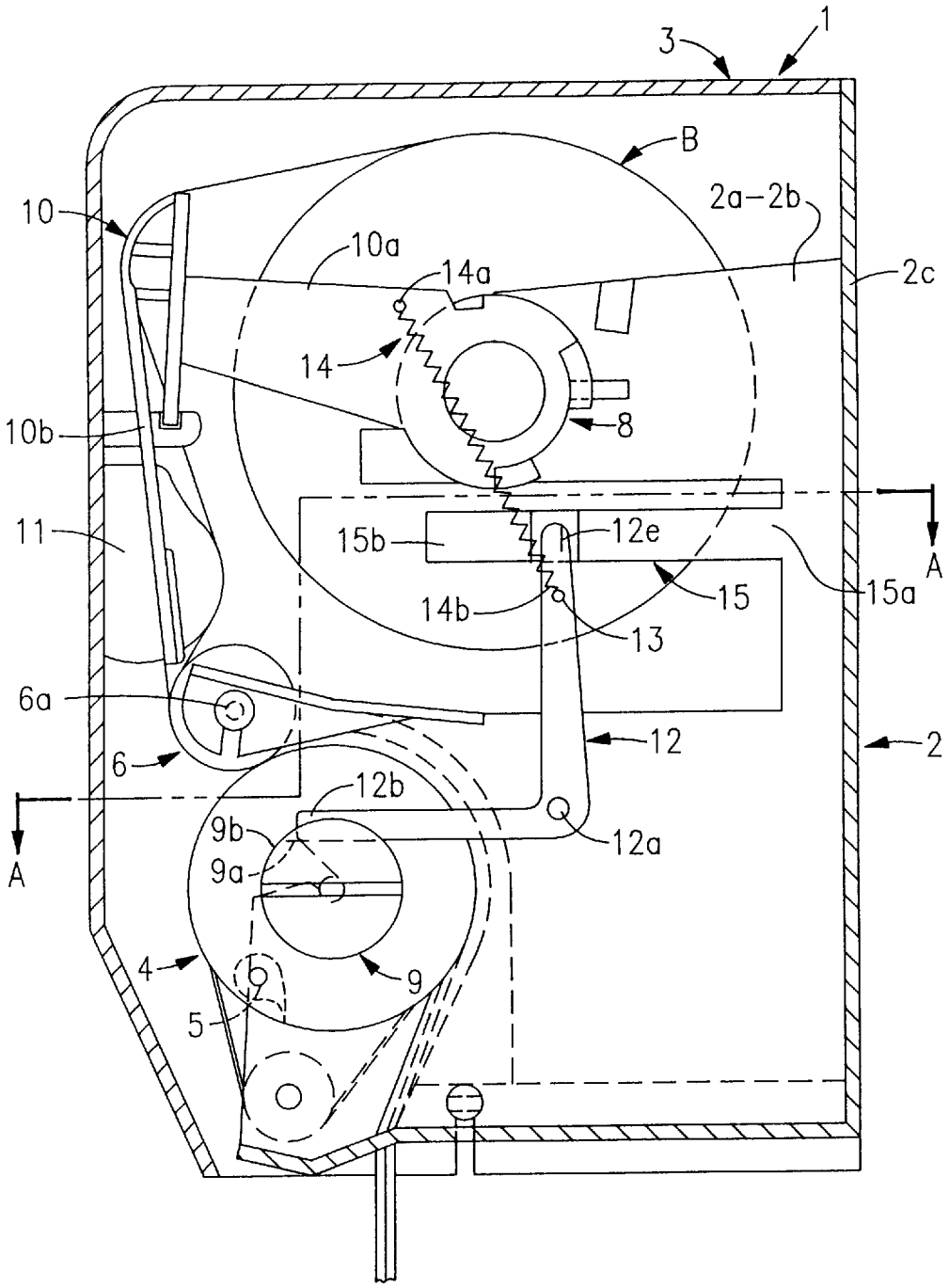
FIG. 1 is a side view of a paper dispensing apparatus with a device for braking the reel shown in the non-operating position of the apparatus when the reel is locked in position.
Figure 2:
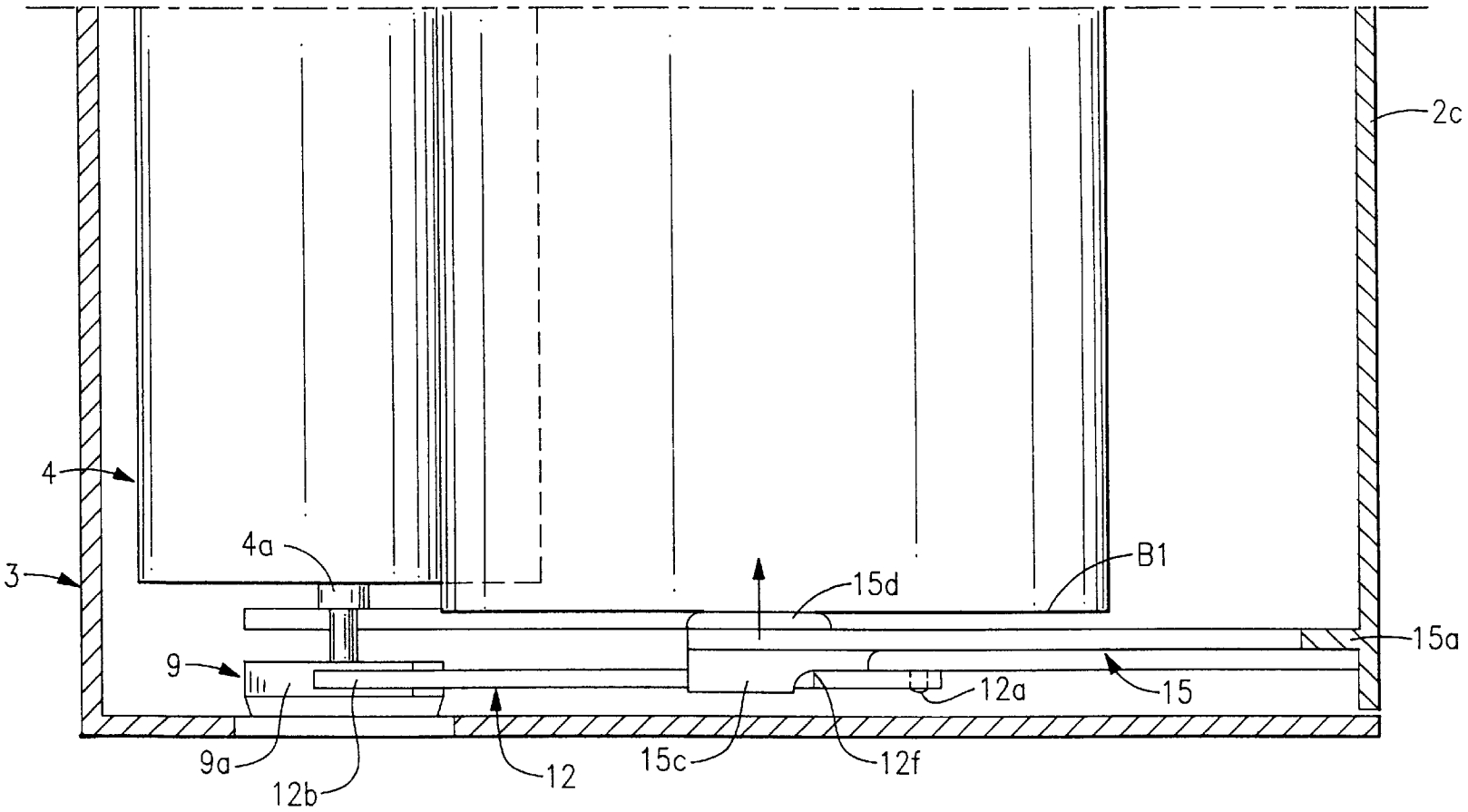
FIG. 2 is a sectional plan view along line A—A in FIG. 1 in the non-operating phase of the apparatus.
Figure 3:
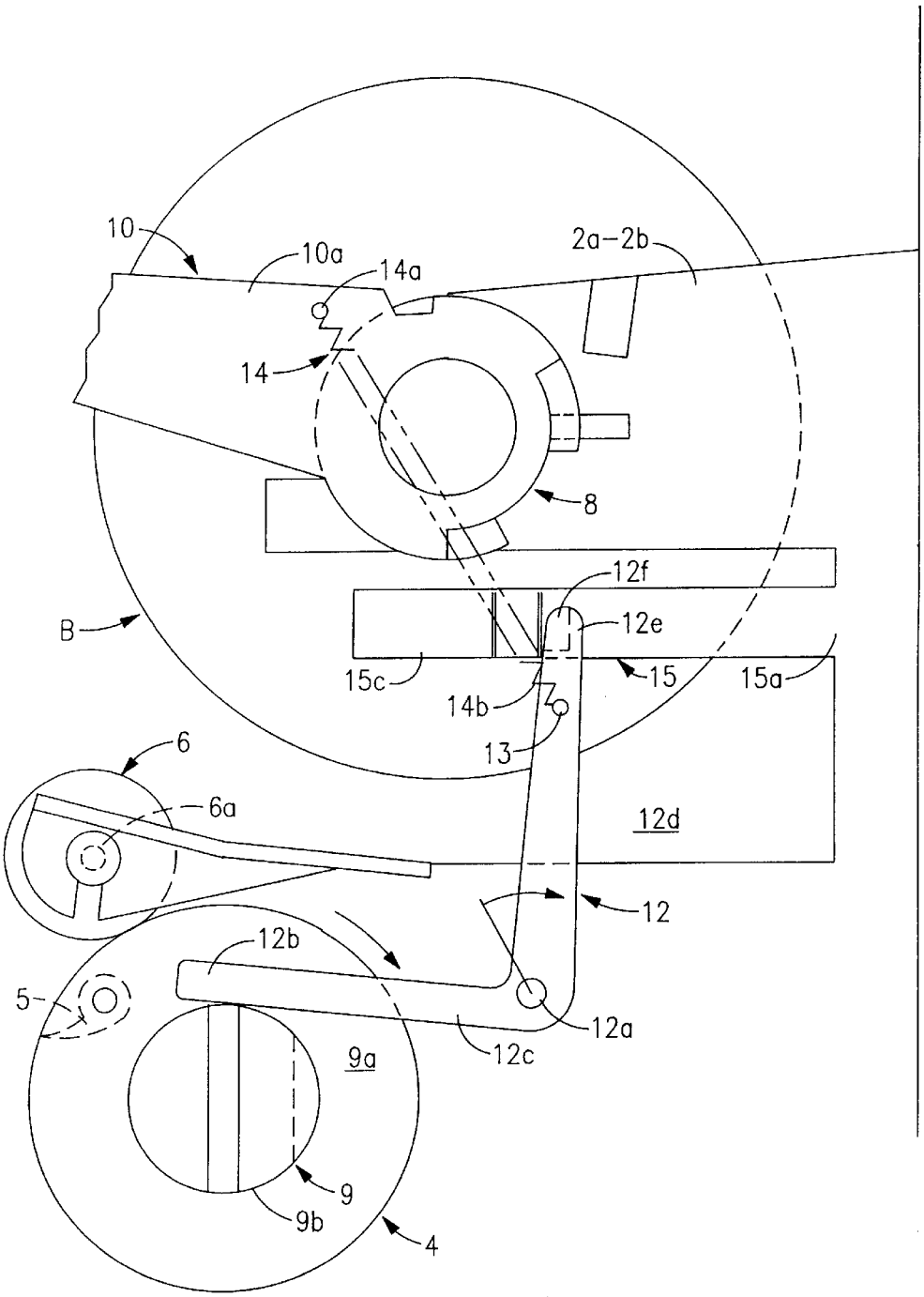
FIG. 3 is a partial large-scale view showing the position of the device in the operating phase of the apparatus and release of the reel.
Figure 4:
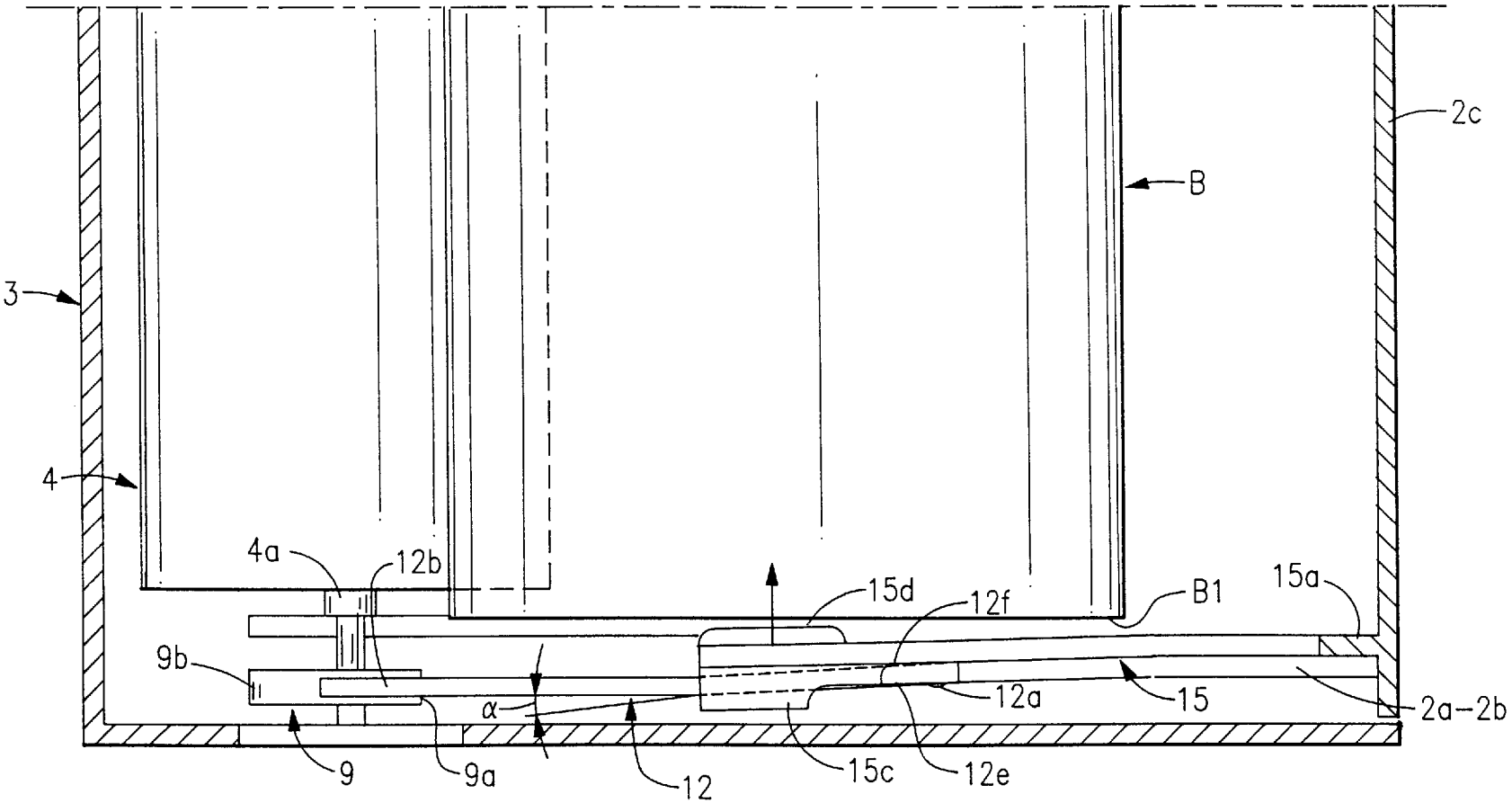
FIG. 4 is a sectional plan view along line A—A in FIG. 1 but in the operating phase of the apparatus.
Figure 5:
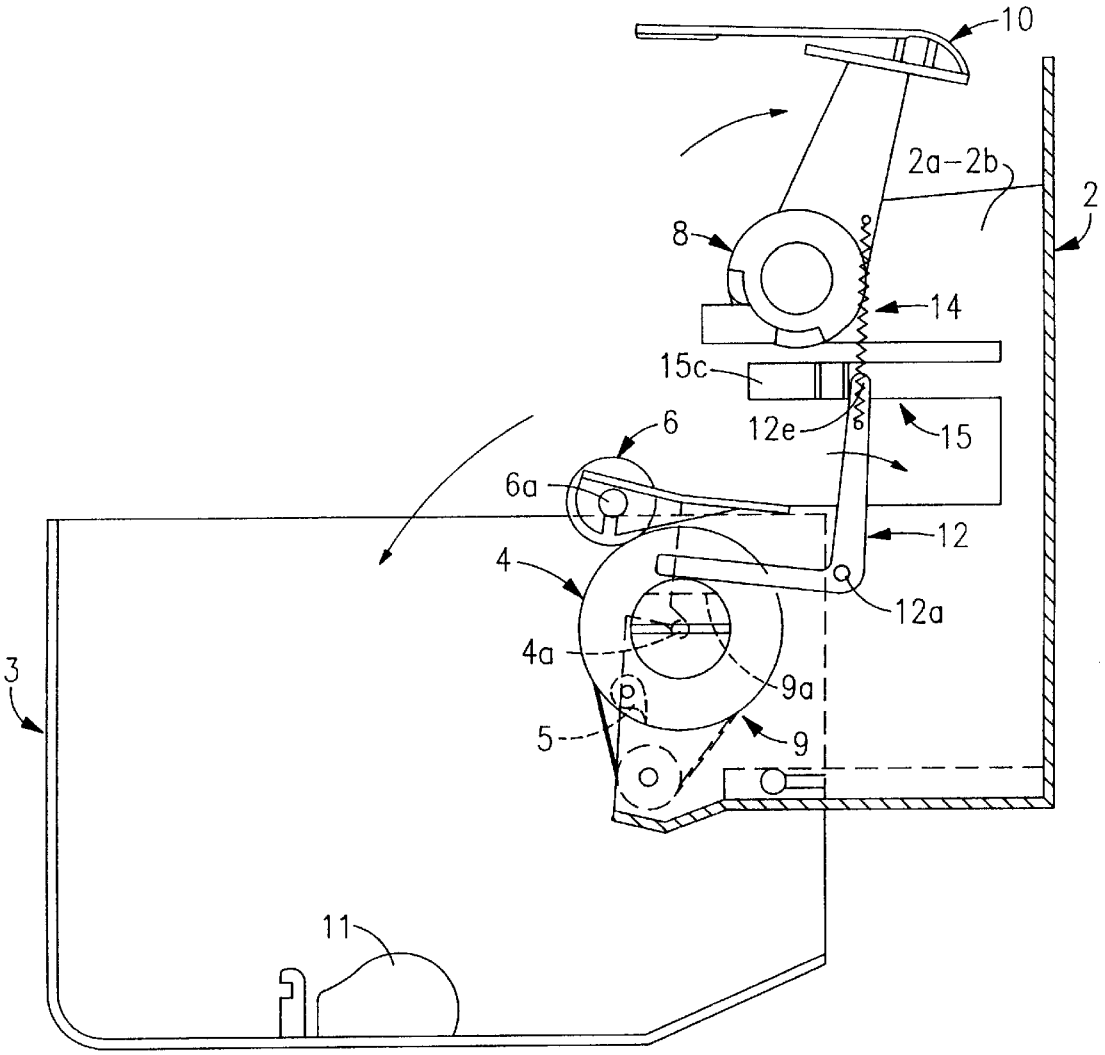
FIG. 5 is a schematic side view showing how the apparatus is loaded with a reel of material and lifting of the frame support allowing folding of the strip of paper.

In order that the present invention may more readily be understood, the following description is given, merely by way of example, reference being made to the accompanying drawings.

DETAILED DESCRIPTION OF THE INVENTION

The apparatus is referred to in its entirety as (1) and comprises a housing (2), a cover (3), a drum (4), a cutting device (5) and a tensioning device (6) as well as means of actuating and reversing the drum, all these components being made of plastic. The upper part of housing (2) has flanges (2*a*–2*b*) capable of accommodating a reel holder or end pieces (8) for supplying a reel (B) of toilet paper or paper towel. The drum (4) that supports the cutting device (5) as well as tensioning device (6) that rests against the drum are arranged between the internal side walls or flanges (2*a*–2*b*) and in the lower part of the housing having scalloping to allow mounting of the shafts (4*a*–6*a*) of the drum and the tensioning device. The end of the drum shaft extends as a control knob (9) allowing loading of the apparatus after threading the strip of paper between the drum and the tensioning device. This control knob is located opposite the mechanism for actuating the drum.

Drum (4) is devised in any appropriate manner, e.g. that defined in the various patents of the Applicant or others.

In one alternative embodiment, the upper part of the housing is capable of accommodating a frame support (10) hinged by its lateral sides (10*a*) relative to lateral flanges (2*a*–2*b*) of the housing. The front middle part of this frame support can accommodate a shaped arm (10*b*) capable of allowing, in cooperation with projections (11) and matching shapes and profiles on the inner surface of cover (3), presentation and folding of the strip of paper as disclosed in above-mentioned previous GRANGER Patents.

Drum (4) and the tensioning device are also secured between flanges (2*a*–2*b*) located at right angles to the rear plane (2*c*) of the housing. The drum comprises a shaft (4*a*) of which the ends extend to form, on the one hand, a control knob and, on the other hand, beyond receiving flange (2*a*), an eccentric lever (16) capable of accommodating an actuating and reverse spring (17).

A follow-on roller (18) is located in the lower part of the housing, its purpose is, in a known manner, to protect the user's hands by being situated at the location where the paper is ejected from the apparatus, and to guide the ejection of the paper.

The object of the invention is a device to brake the take-off reel of paper towel; this device can be used advantageously in an apparatus of the above-mentioned type that allows dispensing of folded or unfolded paper.

Figure 6:
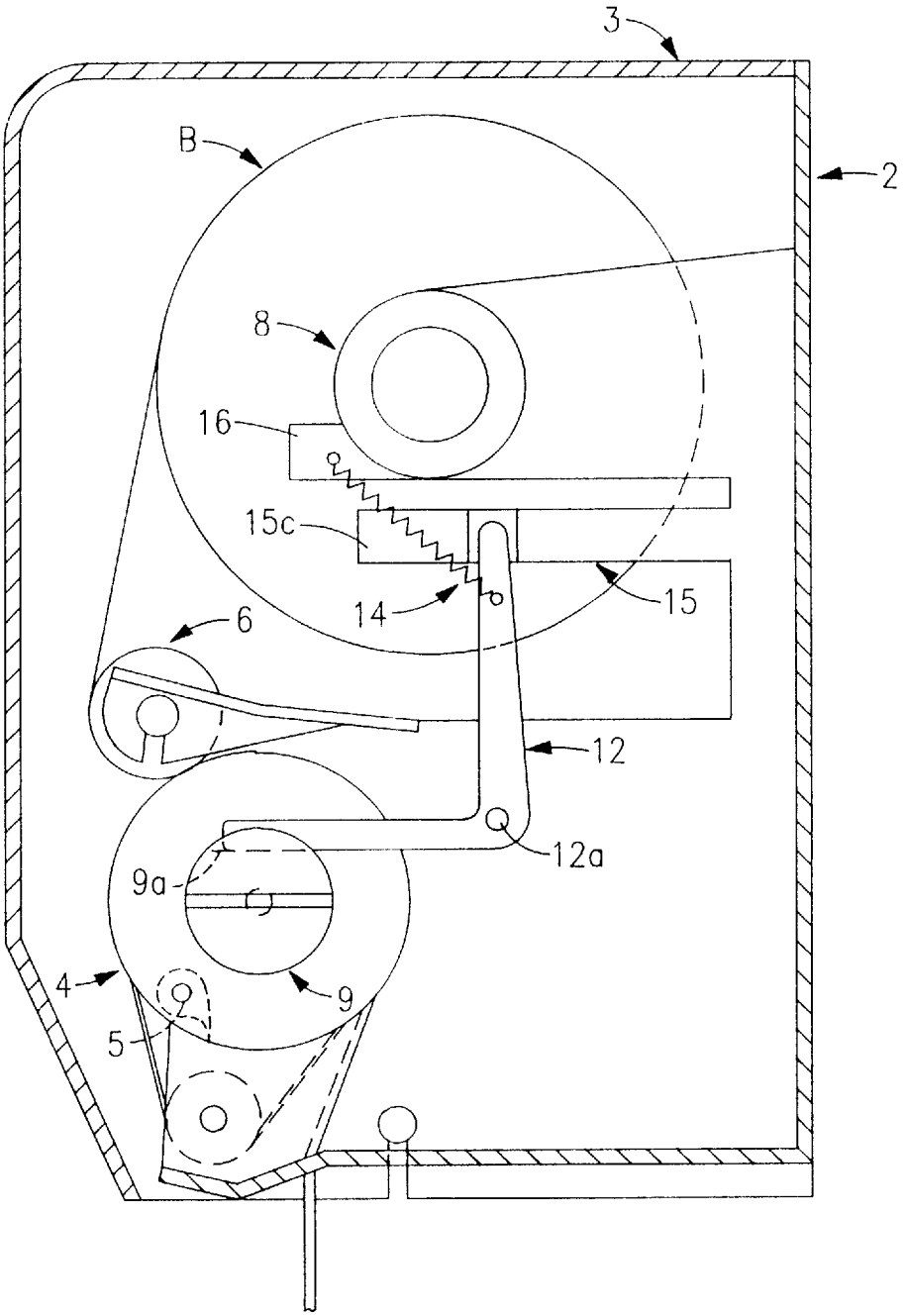
FIG. 6 is a schematic side view showing the invention if the apparatus does not have any frame support for dispensing paper in folded form.
Figure 7:
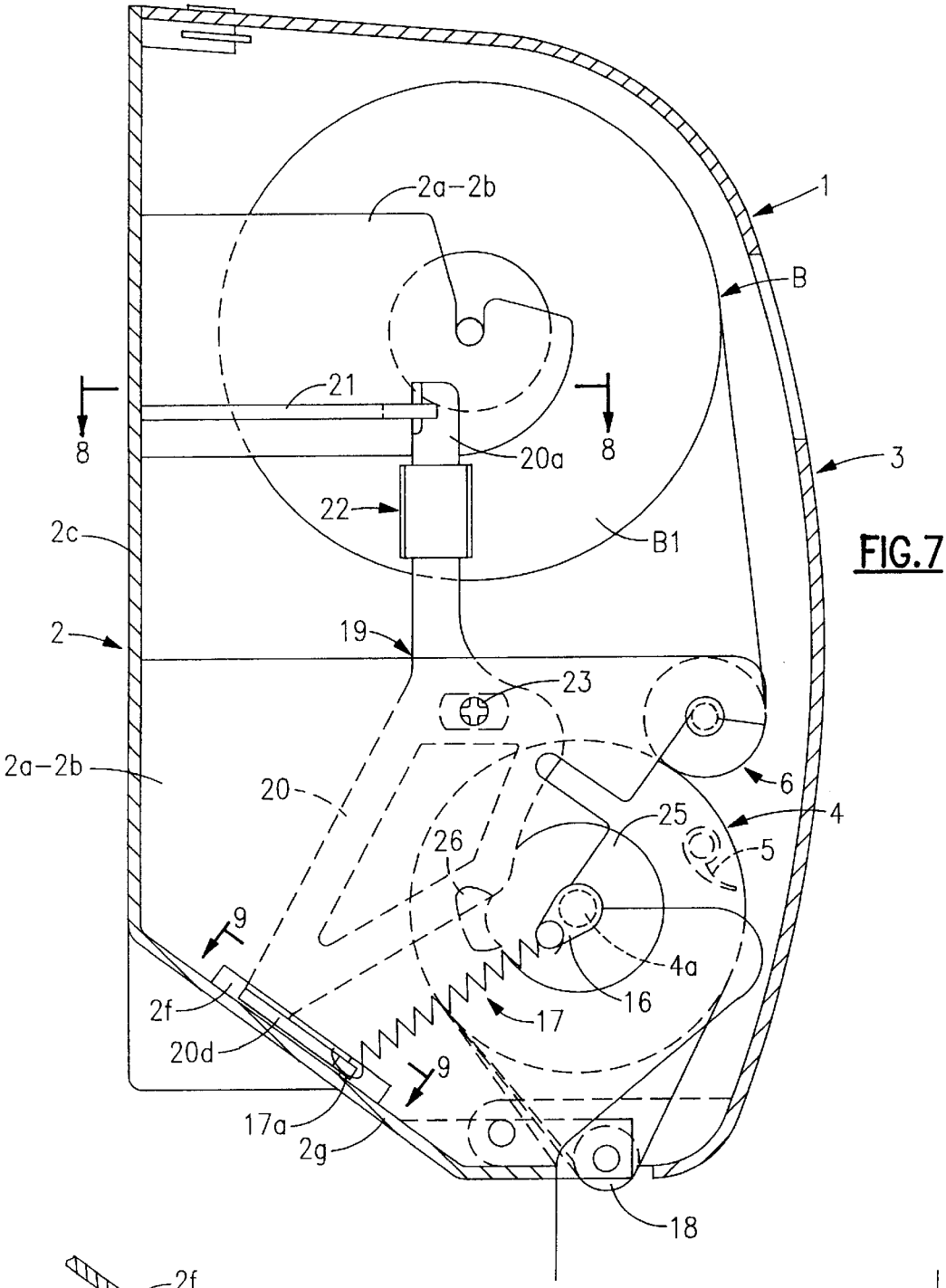
FIG. 7 is a transverse sectional view of a dispensing apparatus including the braking device of the invention.
Figure 9:
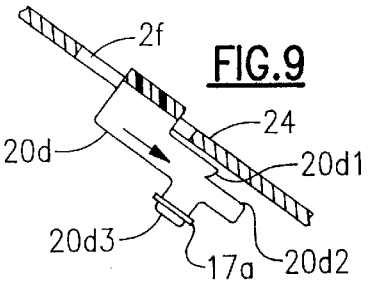
FIG. 9 is a partial sectional view along line 9—9 in FIG. 7 showing the position of the rear hook shaped part of the lever that is part of the braking device.
Figure 8:
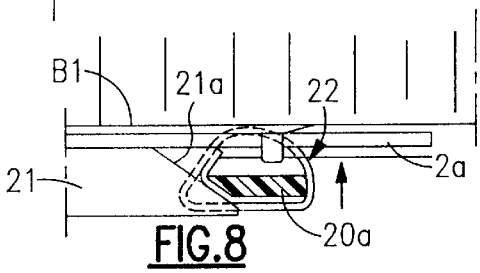
FIG. 8 is a sectional plan view along line 8—8 in FIG. 7 showing the position of the upper part of the arm of the lever of the braking device in the idle state (apparatus not operating).

The device is described below in cases where the apparatus is designed with a swivelling frame support as shown in FIGS. 1 to 5 in the drawings or in FIG. 6 where the frame support has been omitted.

This device is devised in the form of a bent L-shaped lever (12) that is hinged relative to the lateral flange of the housing at its mid point (12*a*). This lever is located on the same side as loading control knob (9) in order to cooperate with the latter. For this purpose, the interior of said control knob is designed with a straight flat (9*a*) on which the free end (12*b*) of the lever, on its essentially horizontal leg (12*c*), presses when the apparatus is idle, i.e. not dispensing paper. Said flat (9*a*) is then also in an essentially horizontal position. The other leg (12*d*) of locking lever (12) is situated in a plane that is at a right angle to the above leg (12*c*) and therefore upwards and vertical and is free. Its upper end (12*e*) has a bevel shape (12*f*). Advantageously, near said lever end, there is a fastening point (13) for one end (14*b*) of a return spring (14) of which the other end (14*a*) is, for instance, fixed to one of the lateral sides (10*a*) of the swivelling frame support. Internally, the housing is designed with a flap (15) along its flange, one end (15*a*) of the flap is fixed to opposite flange (2*a*) near the bottom wall (2*a*) of the housing. The other free end (15*b*) of the flap is shaped with a bump (15*c*) of gradually increasing thickness capable of moving opposite the end of the vertical leg (12*d*) of bent lever (12). The flap thus described has, at its front internal end, a friction area (15*d*) capable of coming into contact with the transverse side (B1) of the reel (B) of paper towel and turns in particular. The friction area is established either by striations formed on the end of the flap or by adding an elastomer capable of providing a braking effect in a particular position.

In the non-operating position of the apparatus, the bevelled end (12*f*) of lever (12) is in contact with bump (15*c*) formed externally on the front end of flap (15) and this causes angular deformation of the flap by an angle $\alpha$ towards the inside opposite the reel, thus helping to place the end of said flap against the reel of material.

In the operating phase of the apparatus, i.e. during dispensing of paper, rotation of the drum under the effect of manual pulling of the paper by the user simultaneously causes rotation of the control knob and, because of this, causes the lower end of the braking lever to escape from the flat part formed on the knob. Because of this the lever, due to the cam effect thus obtained, will be raised and said end will press against the outer periphery (9*b*) of the control knob. The middle part of the lever is hinged relative to the chassis so that its vertical leg (12*d*) will deflect towards the rear thus releasing said flap (15) by allowing it to spring back. The latter will, because it is resilient, return to its initial position in a plane that is perpendicular to the bottom wall of the housing. The external bump formed on the flap as well as the bevelled part formed on the lever are no longer in contact with each other as shown in the drawings. The reel of material can therefore be unwound without difficulty or obstruction for essentially one revolution of the drum which is equivalent to one piece of paper. At the end of the cycle, i.e. after the strip of paper has been cut by the cutting device, control knob (9) will again present its flat part (9*a*) opposite the lower free end of the lever thus allowing, by springing back, the braking lever to be reset to its initial position. This operation then causes the upper leg of the lever to be placed back in contact with the flap and therefore causes the latter to deflect towards the inside against the reel. This produces an immediate braking effect and the reel can no longer be unwound unintentionally.

Note that backward swivelling of the braking lever involves significant extension of return spring (14). Under these conditions, when the lower leg of said lever comes back into contact with the flat part of the control knob, the resilience of above-mentioned spring allows repositioning of the mechanism. The springback force of the spring nevertheless generates a force that is significantly higher in order to overcome the contact resistance of the upper leg of the lever relative to the bump formed on the flap.

If the frame support with an arm is used, as stated earlier, the strip of paper from the reel may happen to pass over the arm and be presented to the drum between the tensioning device and the latter in order to ensure cutting of the paper in a folded position. Alternatively, the strip of paper from the reel may pass directly behind the arm and not travel around the frame support in order to be routed between the tensioning roller and the drum under the same conditions so as to cut an unfolded strip of paper.

It may, however, be necessary and preferable when loading a reel of material to raise the above-mentioned frame support.

Without performing any intervention on the drum and control knob, raising the frame support towards the rear will cause swivelling of spring (14) linked to braking lever (12). Having passed a "dead point" corresponding to axial positioning of the spring relative to the upper leg of the braking lever, the action of swivelling the frame support to the rear will cause backward swivelling of the braking lever through its link with the spring and thus release the flexible flap again. In addition, the lower leg of the lever is no longer in contact with the control knob. The flap springs back into its initial position and leaves the reel of material free. One can therefore very easily load a new reel without the braking device and the flap, in particular, obstructing this operation.

When the reel of material is positioned on end pieces (8) formed on the lateral flanges of the housing, the frame support must then be swivelled again but this time towards the front. In a reverse operation, spring (14) which has been retensioned, pulls braking lever (12) which swivels forwards so that its lower leg **(12*b*) is brought back into contact with control knob (9) and the flat (9*a*)** on the latter in particular. In such a design, the braking device can therefore be used, on the one hand, to control dispensing of the strip of paper and, on the other hand, to release the reel so that it can be loaded.

Still within the scope of the invention and assuming that the apparatus does not comprise a swivelling frame support with an arm in order to allow dispensing of paper in folded form, in this case the upper end of spring (14) is fixed to the reel-holder flange at an appropriate point to allow only the function of braking the reel of material.

The device according to the invention has a very simplified design. For guidance purposes, the upper part of the braking lever can be shaped with a slight offset so that it can come into contact with an externally separately mounted plate that secures it and provides positional guidance.

According to the invention, the flap can be separately mounted or moulded at the same time as the other components of the housing.

With the technology chosen for actuating the drum, a second braking device may, if applicable, be provided on the other side of the reel of paper towel. In this case it is the means of actuating that is designed with a flat area to cooperate with a second braking lever.

The device is simple to produce and implement. It is extremely practical in use. It prevents, if the tensile force exerted by the user on the strip of paper is excessive, the creation of a loose unwound strip which must then be eliminated and which is not tensioned between the reel of material and the drum.

An alternative embodiment of the braking device shown in FIGS. 7 to 15 is described below.

The braking device referred to in its entirety as (19) according to the invention is devised, in certain non-operating phases of the apparatus, to jam against at least one of the flanks (B1) of the reel with the device retracting when the operator exerts a tensile force on the paper causing rotation of the drum over one revolution.

Figure 13:
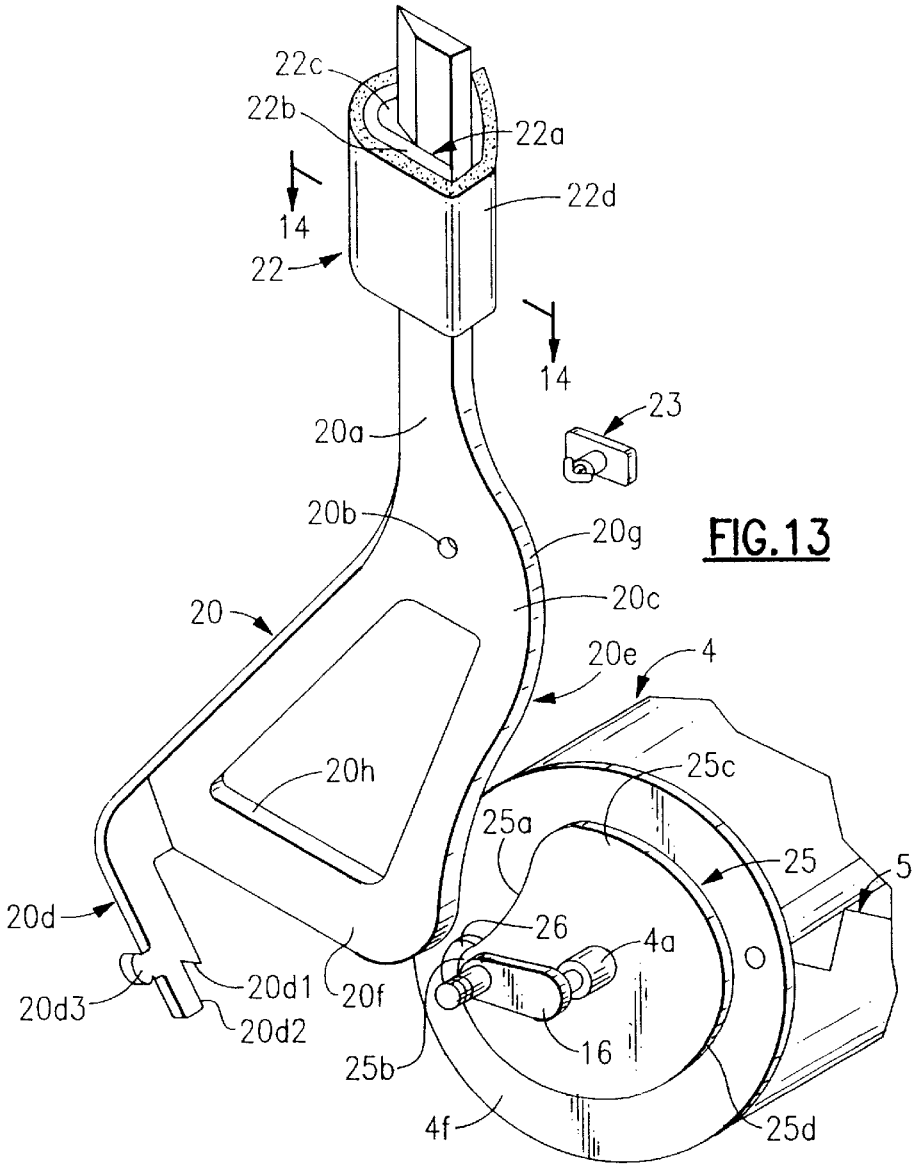
FIG. 13 is a partial perspective view of the braking device comprising a lever that cooperates with a profiled cam on the drum.

For this purpose and according to the invention, the braking device shown in FIG. 13 in particular comprises a long lever (20) of which the upper part has a tapered arm **(20*a*) capable of cooperating with tapered profile (21*a*) forming a matching ramp on a separately mounted plate (21) that is joined to one of the reel-holder upper flanges (2*a*)** formed on the housing. This plate can also be produced at the same time as the flange is produced by moulding.

The upper part of said arm has a protruding shape forming a deformable pad (22) that projects internally between flanges **(2*a*–2*b*) so that it is opposite flanks (B1) of the reel of material. The middle part (20*c*) of said lever (20) is hinged relative to the support flange (2*c*) of drum (4) and of tensioning device (6). This hinging is obtained relative to an opening (20*b*) or hole that accommodates a hinge pin (23). The lower part of said lever (20) is devised to have a backward hook shape (20*d*) capable of passing through a slit (2*f*) or slot in the lower part of flange (2*a*) along bottom wall (2*g*) of the housing. This hook shape (20*d*) is itself shaped to cooperate with a fixed limit stop (24) located in the bottom wall (2*g*) of the housing. This fixed limit stop (24) can be produced as an integral part of said wall at the time of moulding. The inside surface (20*d*1) opposite hook (20*d*) has a step (20*d*2) that is devised so that, in certain operating phases of the apparatus, said step (20*d*2) fits limit stop (24), this phase corresponding to deflection of the upper leg of lever (20), no braking of the reel of material and no braking of the drum. Step (20*d*2)** has an inclined profile to allow satisfactory catching on the limit stop.

The front lower part of said lever (20) also has a special-purpose curved profile **(20*e*) and its lowest part extends as a bent shape (20*f*) in order to define, in cooperation with a shaped cam (25) fixed on flange (4*f*) of the drum, a trajectory that either helps or does not help actuate the braking device. The lower part of the lever has a cutout (20*h*)** to make it lighter.

The hook shaped part **(20*d*) of the lever advantageously constitutes, in the form of a protruding area (20*d*3), the lower attachment point (17*a*) of the spring (17)** that acts as a reverse spring and actuates the drum.

Cam (25) formed on flange **(4*f*) of the drum has, in particular, a dished inner area (25*a*) against which the curved part (20*f*) of braking lever (20) presses, thus defining two protruding points (25*b*–25*c*). Around one of them (25*b*), there is a small separately-mounted moulded shaped plate (26) forming a thicker part that forces the corresponding part of the lever to deflect in certain operating phases. Said cam defines a bearing and movement path for the curved part of the lever. Advantageously, the small separately-mounted plate (26) is situated essentially on the extended axis of that part of the eccentric lever (16) that is used to actuate the drum. Between the protruding points (25*b*–25*c*) of the cam, the latter has an area (25*d*) that can be hollowed, reentrant or of other shape and which corresponds to a large part of the circumference of the cam. This area (25*d*) is ideally not in contact with lever (20)** during movement of the latter so that the lever does not exert any braking force on the cam and hence on the drum.

Figure 14:
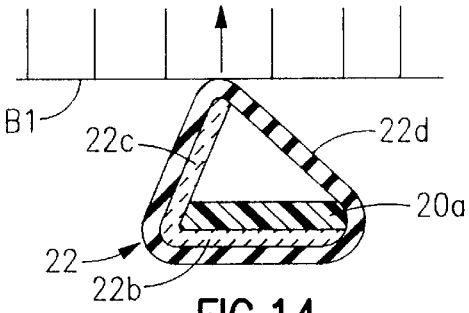
FIG. 14 is a sectional view along line 14—14 in FIG. 13 showing the pad brake on the reel of material.
Figure 15:
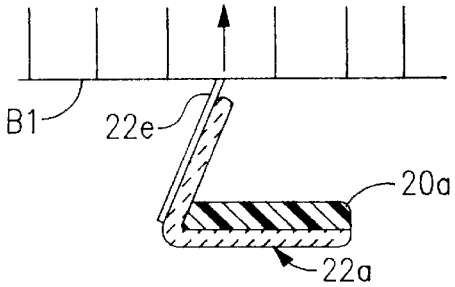
FIG. 15 is a partial view and an alternative view of the means of braking in another embodiment.

As stated above, the upper part of the braking device comprises a projecting part in the shape of a pad (22) that protrudes internally to press against the flank of the reel of material. This protruding shape is devised, for example, as shown in FIG. 14 in the drawings. A V profile **(22*a*) is attached by one (22*b*) of its legs, with the other leg (22*c*) of the profile remaining free. This assembly is surrounded by a rubber packing (22***d*) that gives the assembly a triangular configuration. The end of the free leg (22*c*) of the V profile has a certain degree of elasticity and is capable of being opposite flank (B1) of the reel. In a variation shown in FIG. 15, the free leg (22*c*) of the V profile receives a toothed blade (22*e*) of which the end is capable, under some circumstances, of penetrating into the thickness of the reel and braking the latter. When the end of the free leg (22*c*) comes into contact with the reel, said leg deflects and ensures braking of the reel.

Having described the components of the invention, the operation of the braking device is now explained.

Figure 10:
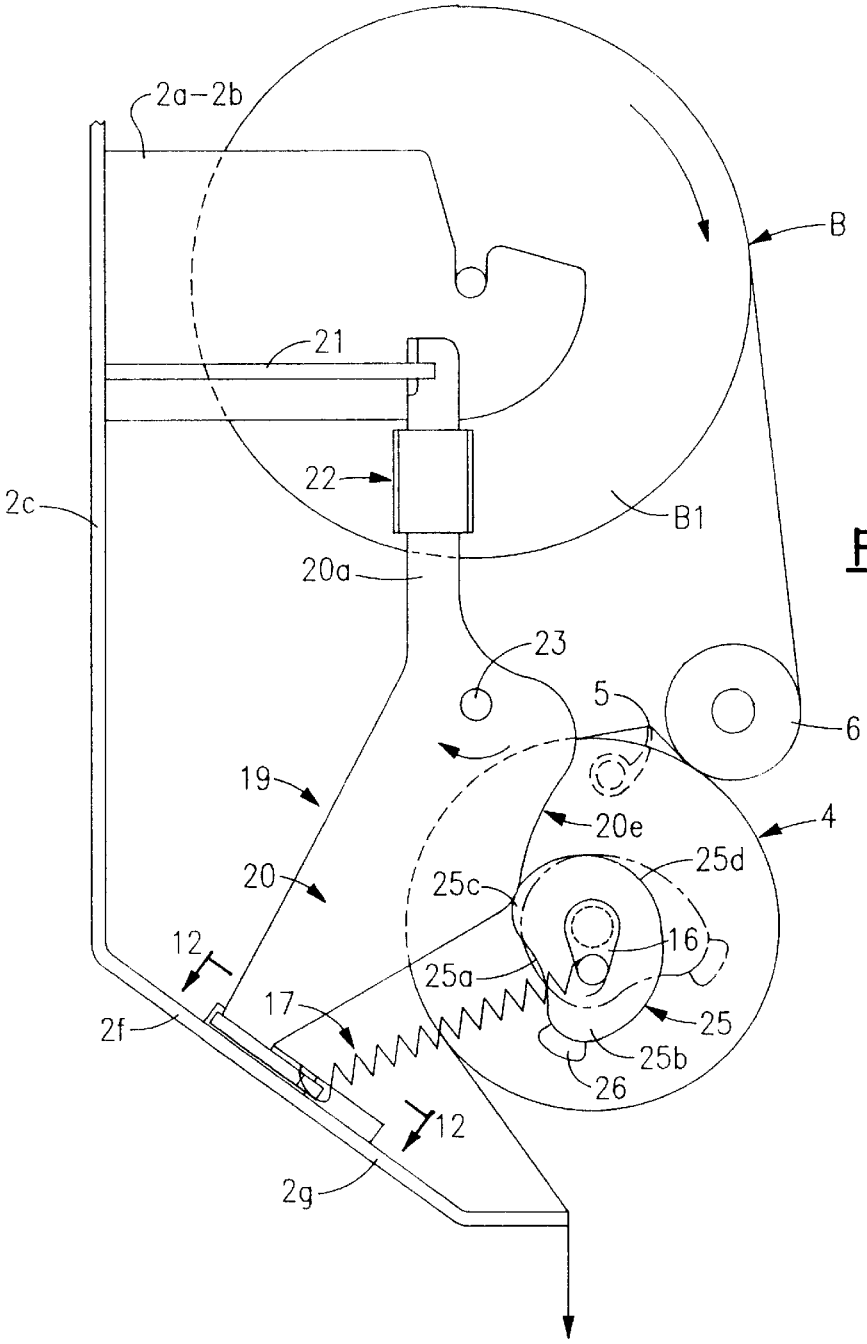
FIG. 10 is a side view showing operation of the braking device according to the invention during rotation of the drum.
Figure 12:
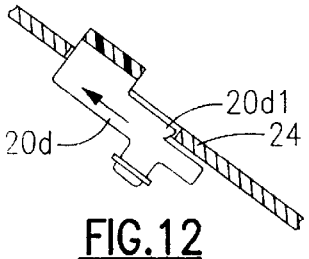
FIG. 12 is a partial sectional view along line 12—12 in FIG. 10, complements FIG. 9 and shows the hook part of the lever retracted towards the rear.
Figure 11:
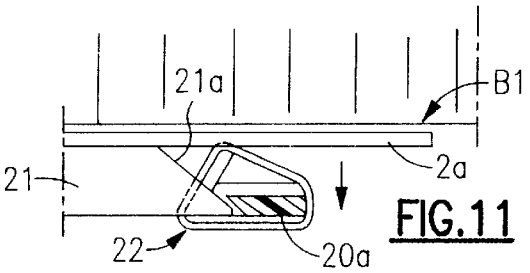
FIG. 11 is a partial plan view of the braking device during action and at the end of pulling and complements FIG. 8.

In the apparatus' idle phase, i.e. no tensile force exerted on the strip of paper, the apparatus is in the configuration shown in FIG. 10, namely the curved part (20*f*) of lever (20) is in the cutaway (25*a*) formed on cam (25) and in contact with the lower protruding point (25*b*) provided on the latter. The upper protruding point (25*c*) presses against narrow edge (20*g*) or the thickness of lever (20). The hook part (20*d*) of said lever is brought towards the front of the apparatus and its inside surface (20*d*1) is up against the length of fixed limit stop (24) formed on the bottom surface of the housing. The upper part of the leg of lever (20) is not deflected so that pad (22) is in firm contact with the flank of the reel. The upper end (20*a*) of the lever is partly down on the ramp profile (21*a*) of small mounting plate (21).

When the user pulls the paper, this causes rotation of the drum and due to the effect of rotating cam (25) associated with the drum, causes swivelling movement of lever (20). This action immediately causes lateral retraction of lever (20) thus releasing the reel of material. It is the upper protruding point (25*c*) on cam (25) that acts against narrow edge (20*g*) of the lever and causes it to swivel backwards. This operation is performed for partial angular rotation of the drum until the lower hook part (20*d*) of lever (20) due to its elasticity, itself catches on the lower limit stop (24) formed on the bottom of the housing. This then produces maximum deflection of lever (20) with its upper end (20*a*) having been displaced externally along ramp (21*a*) of mounting plate (21) associated with the upper flange.

Since this catching on fixed limit stop (24) has caused retraction of the braking device, the apparatus drum continues to rotate, transports the paper and moves the cutting device. Gradual rotation of the drum will cause corresponding displacement of the small plate (26) formed on flange (4*c*) of the drum at the location of the lower protruding point (25*b*) of the cam. At the end of cutting, said small plate (26) gradually comes into contact with narrow edge (20*g*) opposite the lever and deflects the latter again so as to release the lower hook part (20*d*) from limit stop (24) and cause slight swivelling of the upper leg of the lever. One thus reaches the phase in which the curved part (20*f*) of the lever gradually penetrates again into cutaway (25*a*) on the cam and, through the hollow thus formed and in combination with the elastic return force of means of actuating (17), the lever returns to its initial position as indicated above. The protruding part (22) formed on the arm of the lever returns into contact and presses against the flank of the reel.

The braking device thus described is very simple. In every case it allows invariable positioning of the drum in the same positioning area, thus ensuring constantly uniform dispensing of the paper. The configuration of the braking device (22) causes ejection of a constant, predetermined length of strip of paper.

The operating lever is therefore subjected to a double swivelling movement exerted on its upper part and lower part and forms a rocking arm that ensures completely safe movements.

The positioning of lever (20) together with its hook part makes it possible, when not braking, to release any pressure exerted on the drum.

I claim:

1. A paper towel dispensing apparatus comprising a housing having lateral flanges capable of accommodating reel-holding means in an upper part of said housing for supporting and feeding a reel of paper material, said housing having a lower part including a drum supporting a cutting device and means for applying pressure against said drum for allowing transport of a strip of paper material from said reel along a paper travel path for purposes of dispensing and ejecting said strip as pulled by a user, said drum and said pressure applying means having shafts sized to be mounted crosswise between said lateral flanges in said housing, at least one of the ends of a drum shaft extending as a control knob, wherein said apparatus further includes at least one braking device for braking said reel of paper material, said device being operatively associated with an operating cycle of said apparatus in which one revolution of said drum dispenses a predetermined length of paper material, said braking device being laterally disposed on one side of said drum and hinged relative to said housing, said device being directly linked to the rotational movement of said drum to provide braking-action contact on at least one lateral side of said reel and release therefrom as controlled by the pulling action of the user on an emerged strip of paper material.

2. A dispensing apparatus as claimed in claim 1, wherein said at least one braking device includes a bent L-shaped braking lever hingably attached relative to a lateral flange of said housing, said braking lever having a pair of legs and positioned such that a first leg is in contact with said control knob and a second leg is located in a plane at a right angle to said first leg, said second leg having a beveled area for moving into and out of engagement with a flexible means, said flexible means having a function area for contacting a transverse side of said reel, and shaped to cooperate with said lever as a cam, wherein contact of said flexible means with said braking lever creates an angular deformation of said flexible means to cause a braking operation of said reel and release of said reel when said beveled area is disengaged from the flexible means.

3. A dispensing apparatus as claimed in claim 2, wherein an end of the first leg of said braking lever presses against the control knob associated with said drum, said knob comprising a flat part against which the leg of the braking lever presses in the braking position of the reel, and an outer periphery against which the leg of said braking lever presses when the drum is rotated over one revolution and the reel is freed.

4. A dispensing apparatus as claimed in claim 2, wherein the flexible means includes a flap, one end of said flap being fixed to the rear of the housing and to a lateral flange, the other free end of the flap being shaped with a bump of gradually increasing thickness capable of moving opposite and cooperating with an end of a vertical leg of the bent braking lever, said flap also having, at a front internal end, a friction area capable of coming into contact with the transverse side of the reel.

5. A dispensing apparatus as claimed in claim 2, including a frame support hinged, by lateral sides, to said lateral flanges, said apparatus including an arm cooperating with shaped projections on the inner surface of a housing cover, wherein the bent braking lever is associated with a reverse spring, one end of which is fixed to the lever, with a second end of said spring being fixed to one of the lateral sides of the frame support.

6. A dispensing apparatus as claimed in claim 5, in which the apparatus, when loaded, raises the frame support towards the rear in which the reverse spring linked to the braking lever enables, having passed a dead point corresponding to axial positioning of the spring relative to the second leg of the lever, the action of swivelling the braking lever to the rear, the release of the flexible flap and the disengagement of the first leg of the braking lever relative to the control knob.

7. A dispensing apparatus as claimed in claim 1, wherein said bent braking lever is associated with a reverse spring, one end of said spring being fixed to said lever and a remaining end to a fixed point of a corresponding lateral flange of the housing.

8. A dispensing apparatus as claimed in claim 2, wherein said bent braking lever is a first braking lever, said apparatus including a second braking lever having a pair of legs and arranged on the other lateral side of the drum to cooperate, by means of one of said legs, with actuating means associated with the drum, said actuating means being fitted with a flat positioning area for cooperating with said leg.

9. A dispensing apparatus as claimed in claim 1, wherein the braking device comprises a long lever having a middle part which is hinged to a lateral flange and an upper part having an arm that cooperates with a shape forming a ramp on a support plate, said arm accommodating means forming a pad that protrudes against a flank of the reel, and in that the lower part of the lever has a hook shape that cooperates with a fixed limit stop placed in the lower part of the housing, said lever also having a curved profile that cooperates with a cam placed on a flange of the drum, said cam being shaped to allow a trajectory of the lever during rotation of the drum or its stopping in order to define the braking and non-braking phases of the reel of material, with the drum being freed due to the absence of friction.

10. A dispensing apparatus as claimed in claim 9, wherein the hook shape of the lower part of said lever is capable of passing through a slit in a lateral flange, said hook shape cooperating with the fixed limit stop and enabling the fixing of an elastic reverse means for actuating the drum.

11. A dispensing apparatus as claimed in claim 10, wherein the hook shape has, on an inner surface, a step with an inclined profile, cooperating, in certain phases, with the limit stop.

12. A dispensing apparatus as claimed in claim 10, wherein the hook shape of the lever has a protruding area forming a lower attachment point for a reverse spring used to actuate the drum.

13. A dispensing apparatus as claimed in claim 9, wherein the lever has, in its lower part, a curved profile terminating in a bent part to cooperate with a cam fixed on the flange of said drum, said lever having a narrow edge forming an area which presses against the cam.

14. A dispensing apparatus as claimed in claim 9, wherein said means forming a pad is arranged in the upper part of the lever, and has a V-shape, one leg of which is fixed to an arm of the lever with the other leg being free to allow elastic pressure to be applied against the flank of the reel, the elastic pressure helping to stop and brake the reel.

15. A dispensing apparatus as claimed in claim 14, wherein said means forming a pad receives a rubber packing to create a triangular shaped pressing configuration.

16. A dispensing apparatus as claimed in claim 14, wherein the free leg of the V-shape receives a toothed blade.

17. A dispensing apparatus as claimed in claim 9, wherein the cam includes a dished inner area having two protruding points wherein the lower protruding point includes a small plate forming a thicker part around the lower protruding point, and an upper protruding point capable of contacting a narrow edge of the lever during rotation of the drum to ensure distancing of the lever when not braking, said small plate being capable of causing displacement of the lever to return it to the braking position.

18. A dispensing apparatus as claimed in claim 17, in which the cam has an area between both protruding points which is not in contact with the lever when the lever is displaced around the cam during rotation of the drum.

* * * * *